US008082902B2

(12) United States Patent
Kim et al.

(10) Patent No.: US 8,082,902 B2
(45) Date of Patent: Dec. 27, 2011

(54) PIEZO INTENSIFIER FUEL INJECTOR AND ENGINE USING SAME

(75) Inventors: Hoisan Kim, Dunlap, IL (US); Mark Sommars, Sparland, IL (US); Dennis Gibson, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 1092 days.

(21) Appl. No.: 11/975,594

(22) Filed: Oct. 19, 2007

(65) Prior Publication Data

US 2009/0101112 A1 Apr. 23, 2009

(51) Int. Cl.
*B05B 1/30* (2006.01)

(52) U.S. Cl. ..... 123/446; 123/447; 123/456; 239/584

(58) Field of Classification Search ..... 123/446, 123/447, 457, 472, 478, 490, 501, 502; 239/584
See application file for complete search history.

(56) References Cited

U.S. PATENT DOCUMENTS

| | | | | |
|---|---|---|---|---|
| 5,697,343 | A | 12/1997 | Isozumi et al. | |
| 5,878,720 | A | 3/1999 | Anderson et al. | |
| 6,085,992 | A | 7/2000 | Chockley et al. | |
| 6,113,000 | A | 9/2000 | Tian | |
| 6,119,960 | A | 9/2000 | Graves | |
| 6,189,815 | B1 * | 2/2001 | Potschin et al. | 239/533.2 |
| 6,675,773 | B1 | 1/2004 | Mahr et al. | |
| 6,729,600 | B2 | 5/2004 | Mattes et al. | |
| 2002/0174854 | A1 | 11/2002 | Lei | |
| 2002/0185112 | A1 | 12/2002 | Lei | |
| 2005/0167523 | A1 | 8/2005 | Haji | |

FOREIGN PATENT DOCUMENTS

| | | |
|---|---|---|
| DE | 19910970 | 9/2000 |
| DE | 10008268 | 8/2001 |
| DE | 102005042652 | 3/2007 |
| EP | 1790847 | 5/2007 |
| GB | 2012360 | 7/1979 |
| WO | 2004/016936 | 2/2004 |

* cited by examiner

*Primary Examiner* — Stephen K Cronin
*Assistant Examiner* — Raza Najmuddin
(74) *Attorney, Agent, or Firm* — Liell & McNeil

(57) ABSTRACT

A common rail fuel injection system includes a piezo intensifier fuel injector that includes a plurality of components. Among these are a needle valve member, an intensifier piston, a first piezo stack electrical actuator and a second piezo stack electrical actuator. These components have a first configuration at which the needle valve member blocks a nozzle outlet of the fuel injector, and a shoulder of the intensifier piston is exposed to fluid pressure in a common rail. The components have a second configuration at which the nozzle outlet is fluidly connected to the common rail for a low pressure injection event. The components have a third configuration at which the nozzle outlet is fluidly blocked from the common rail, but movement of the intensifier displaces fluid through the nozzle outlet for a high pressure injection event.

19 Claims, 5 Drawing Sheets

PIEZO INTENSIFIER FUEL INJECTOR AND ENGINE USING SAME

TECHNICAL FIELD

The present disclosure relates generally to engines with common rail fuel injection systems, and more particularly to a piezo controlled fuel injector equipped with an intensifier piston.

BACKGROUND

In recent years, the compression ignition engine industry has come to recognize that common rail fuel systems may have certain advantages over other previously known fuel systems with regard to increasing performance while reducing undesirable emissions. Undesirable emissions include, but are not limited to, NOx, hydrocarbons and particulate matter. Common rail fuel systems typically include a shared reservoir or common rail containing fuel pressurized by a high pressure pump. Individual fuel injectors for each engine cylinder are positioned for direct injection into the respective cylinders and are individually fluidly connected to the common rail via separate branch passages. Originally, common rail fuel systems included some sort of electronically controlled valving system that allowed each fuel injector to be connected to the common rail for an injection event at any desirable engine timing independent of engine crank angle. However, such system were limited as far as injection pressure to the pressure of the fuel in the common rail.

A later innovation in common rail fuel systems is disclosed, for instance, in U.S. Pat. No. 6,675,773 to Mahr et al. This reference teaches the incorporation of a previously known intensifier piston into a common rail fuel injector. Using appropriately controlled valves, this fuel injection system has the ability to inject directly from the rail as in previous common rail systems, but also inject at an elevated or intensified pressure utilizing the intensifier piston. The intensifier piston typically includes a pressure increase via a step piston that includes a large surface area and a small surface area. The large surface is acted upon by rail pressure, and the fuel adjacent the small surface in increased in pressure in proportion to the area ratio between the large surface and small surface. Although fuel systems of the type described in the '773 patent appear to show promise, they are not without problems. For instance, different fuel injectors that appear identical will behave differently because of the multitude of stacked interactions of various components within the fuel system. In addition, these system variations can also change over time. Furthermore, there is always an urge in the industry to seek ever higher injection pressures, which tend to compound all of the other problems associated with fuel injector control and performance variations among apparently identical fuel injectors. Finally, the industry continues to demand ever more versatility, repeatability and reliability from all fuel injection strategies.

The present disclosure is directed to one or more of the problems set forth above.

SUMMARY OF THE DISCLOSURE

In one aspect, a fuel injector includes an injector body with a high pressure inlet, a low pressure drain and a nozzle outlet. The injector body also includes a nozzle supply passage, a needle control chamber and a shoulder control chamber disposed therein. First and second electrical actuators, which each include a piezo stack, are positioned in the injector body.

An intensifier piston is slidably positioned in the injector body with a shoulder surface that is exposed to a fluid pressure in a shoulder control chamber, which is located between a large surface and a small surface. The fuel injector also includes a needle valve member with an opening hydraulic surface exposed to fluid pressure in the nozzle supply passage, and a closing hydraulic surface exposed to fluid pressure in the needle control chamber. A direct control valve member is coupled to the first electrical actuator and is movable between a first position at which the needle control chamber is fluidly connected to a low pressure drain, and a second position at which the needle control chamber is fluidly blocked to the low pressure drain. An intensifier control valve is coupled to the second electrical actuator and is movable between a first position at which the shoulder control chamber is fluidly connected to the low pressure drain, and a second position at which the shoulder control chamber is fluidly blocked to the low pressure drain.

In another aspect, an engine includes an engine housing with a plurality of cylinders disposed therein. The plurality of fuel injectors each include a nozzle outlet positioned for direct injection into a different one of the cylinders. Each of the fuel injectors includes a plurality of components. A common rail is fluidly connected to each of the fuel injectors. The plurality of components include a needle valve member, an intensifier piston, a first piezo stack electrical actuator, and a second piezo stack electrical actuator. The plurality of components have a first configuration at which the needle valve member blocks the nozzle outlet, and a shoulder surface of the intensifier piston is exposed to fluid pressure in the common rail. The plurality of components have a second configuration at which the nozzle outlet is fluidly connected to the common rail for a low pressure injection. The plurality of components have a third configuration at which the nozzle outlet is fluidly blocked from the common rail but movement of the intensifier displaces fluid through the nozzle outlet for a high pressure injection.

In still another aspect, a method of operating the fuel injection system includes a step of fluidly connecting a nozzle outlet of a fuel injector to a common rail for a low pressure injection event by energizing one, but not both, of a first electrical actuator and a second electrical actuator. An intensifier piston is moved with fluid pressure from the common rail for a high pressure injection event by energizing both the first and second electrical actuators. Both ends and a shoulder surface of the intensifier piston, as well as both an opening hydraulic surface and a closing hydraulic surface of a needle valve member are exposed to pressure in the common rail by de-energizing both the first and second electrical actuators.

DETAILED DESCRIPTION

Figure 1:
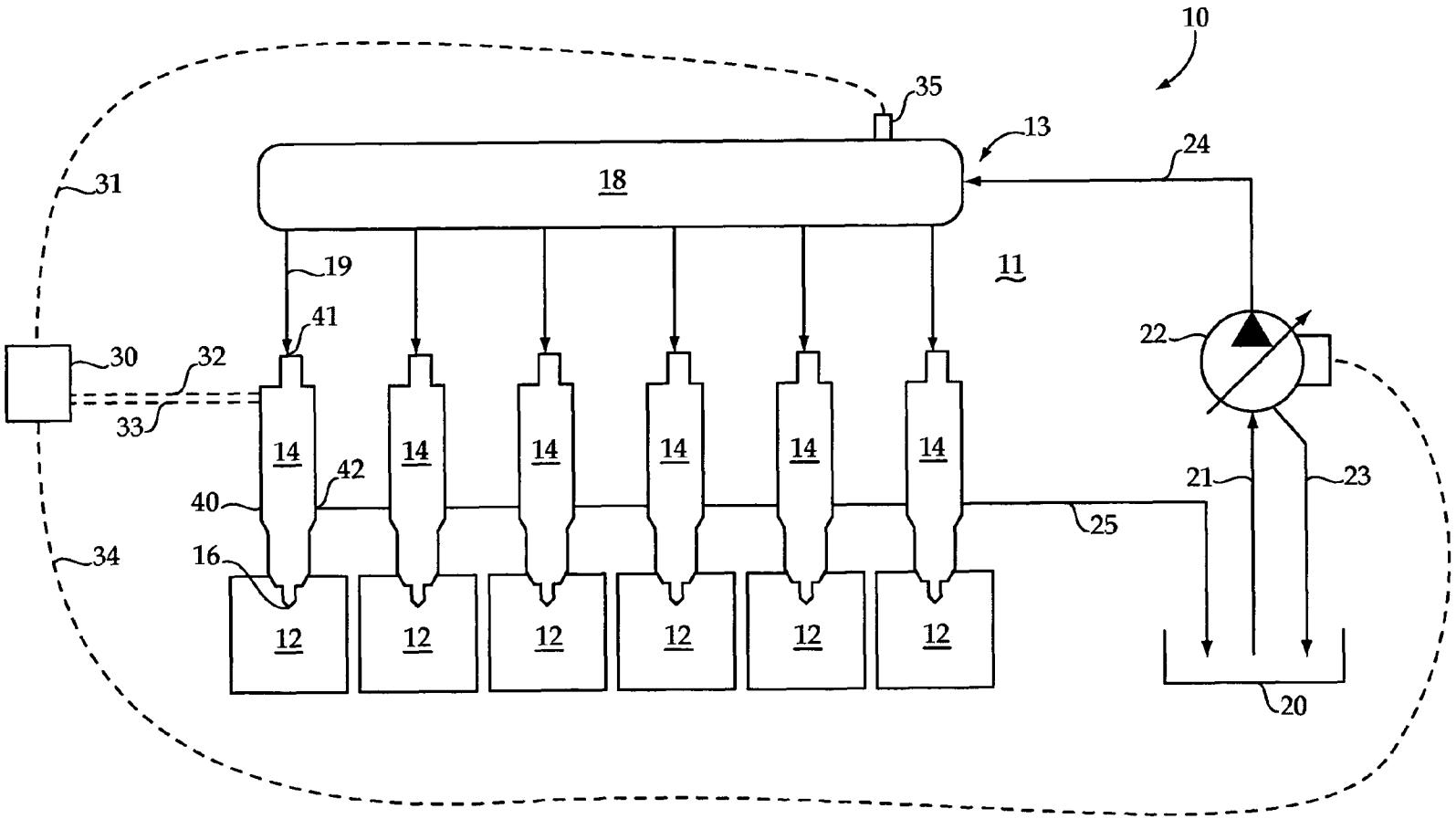
FIG. 1 is a schematic view of an engine according to the present disclosure.
Figure 2:
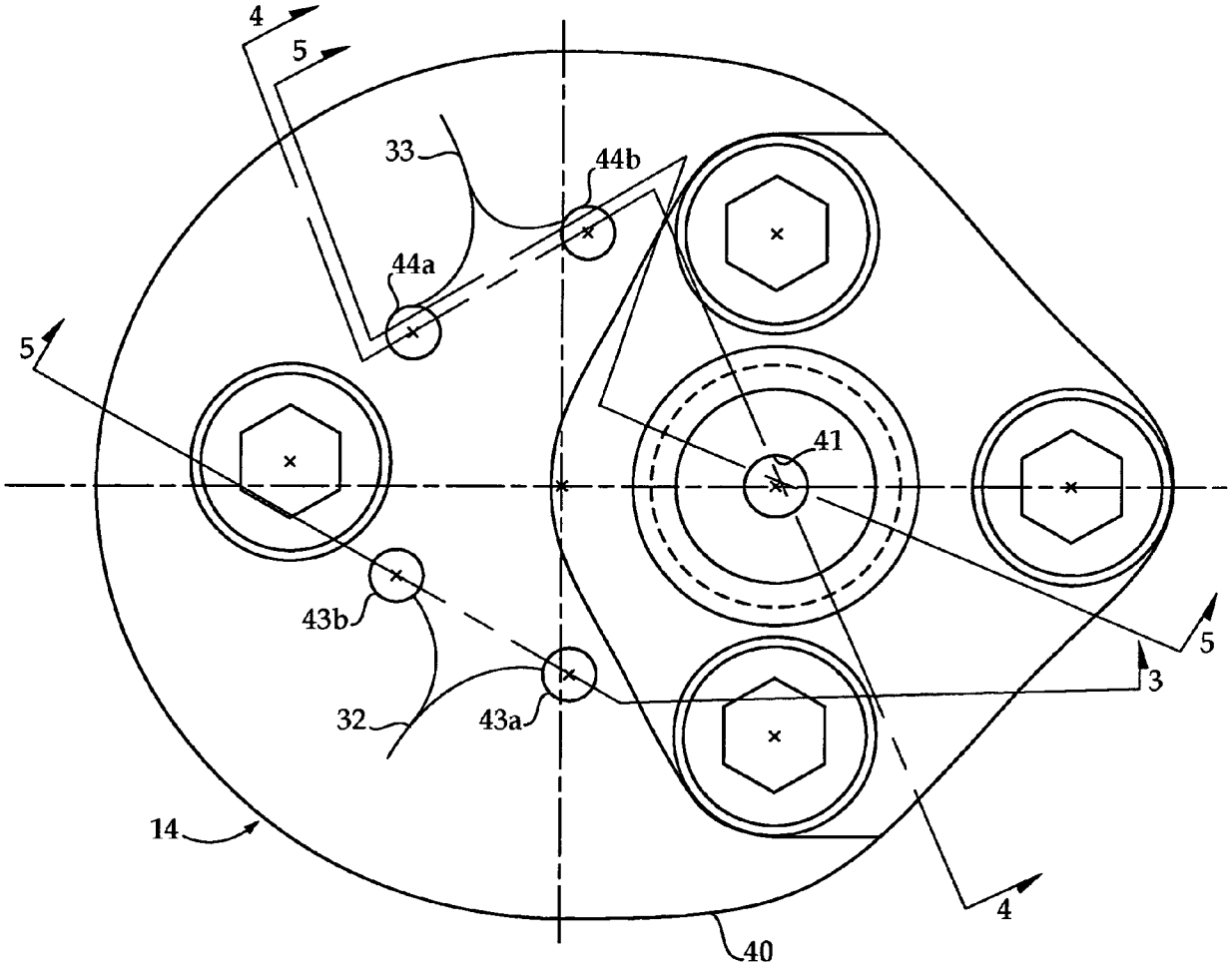
FIG. 2 is a top view of a fuel injector according to one aspect of the present disclosure.

Referring to FIG. 1, an engine 10 includes a common rail fuel injection system 13 and a housing 11 with a plurality of engine cylinders 12 disposed therein. A plurality of fuel injectors 14 each include a nozzle outlet 16 positioned for direct injection into different ones of the engine cylinders 12 in a conventional manner. Each of the fuel injectors 14 includes a high pressure inlet 41 that is fluidly connected to a common rail 18 via an individual branch passage 19. The fuel injectors 14 also include a low pressure drain port 42 that are commonly connected to a low pressure drain line 25 that empties into fuel tank 20. Fuel is drawn from fuel tank 20 via a fuel transfer pump (not shown) positioned in a low pressure fuel supply line 21 for supplying fuel to a variable displacement high pressure pump 22. Variable displacement pump 22 is controlled via a communication line 34 by an electronic controller to displace high pressure fuel into or toward common rail 18 via high pressure supply line 24, or low pressure fuel back to tank via return line 23.

Electronic controller 30 receives inputs from a variety of sensors that are not shown but also a pressure sensor 35 that provides pressure information regarding common rail 18 via a communication line 31. This information is used by electronic controller 30 to control variable displacement pump 22 in order to maintain pressure in common rail 18 at some desired level, such as a pressure on the order of about 160 MPa. Common rail fuel injection system 13 is also controlled by electronic controller 30 via individual control signals supplied to each of the fuel injectors 14 via communication lines 32 and 33, respectively. Only one pair of communication lines 32 and 33 are shown; however, those skilled in the art will appreciate that electronic controller 30 communicates with, and controls each, of the fuel injectors 14 with a pair of communication lines. Two communication lines 32 and 33 are shown as each fuel injector 14 includes first and second electrical actuators as discussed infra.

Referring now to FIGS. 2-5, each fuel injector 14 includes an injector body 40 that includes electrical terminals 43*a* and *b* for connection to communication line 32, as well as electrical terminals 44*a* and *b* for connection to communication line 33. Terminals 43*a-b* correspond to the first electrical actuator, whereas terminals 44*a* and 44*b* correspond to the second electrical actuator. Each of the fuel injectors 14 include a multi-component injector body 40 as well as a variety of internal stationary and movable components and fluid passages. Among these components are a first piezo stack electrical actuator 50 and a second piezo stack electrical actuator 51, which may be identical in construction. Each fuel injector 14 also includes an intensifier piston 80 which includes a shoulder surface 87 separating a large surface 89 from a small surface 88. The area ratio of large surface 89 to small surface 88 may be on the order of about two, resulting in a pressure increase of about 1.7 times rail pressure after losses are taken into account. Also among the plurality of components of each fuel injector 14 is a directly controlled needle valve member 60 that includes an opening hydraulic surface 61 exposed to fluid pressure in a nozzle supply passage 72, and a closing hydraulic surface 62 exposed to fluid pressure in a needle control chamber 91. Movement of needle valve member 60 is controlled by first piezo stack electrical actuator 50, whereas movement of intensifier piston 80 is controlled by the second piezo stack electrical actuator 51.

A nozzle outlet 16 is normally closed by needle valve member 60 being seated as shown to block nozzle outlet 16 to nozzle supply passage 72 under the action of biasing spring 69 in a conventional manner. Between injection events, the large surface 89, shoulder surface 87 and small surface 88 of intensifier piston 80, as well as both the opening hydraulic surface 61 and closing hydraulic surface 62 of needle valve member 60 are all exposed to common rail fuel pressure between injection events, via different passages which will be discussed more thoroughly infra, when both first electrical actuator 50 and second electrical actuator 51 are de-energized. Although both the first and second electrical actuators 50 and 51 are piezo stacked controlled, those skilled in the art will appreciate that a likely inferior fuel injector could also utilize a solenoid for one or both of the electrical actuators to produce a system still falling within the intended scope of the present disclosure.

Figure 3:
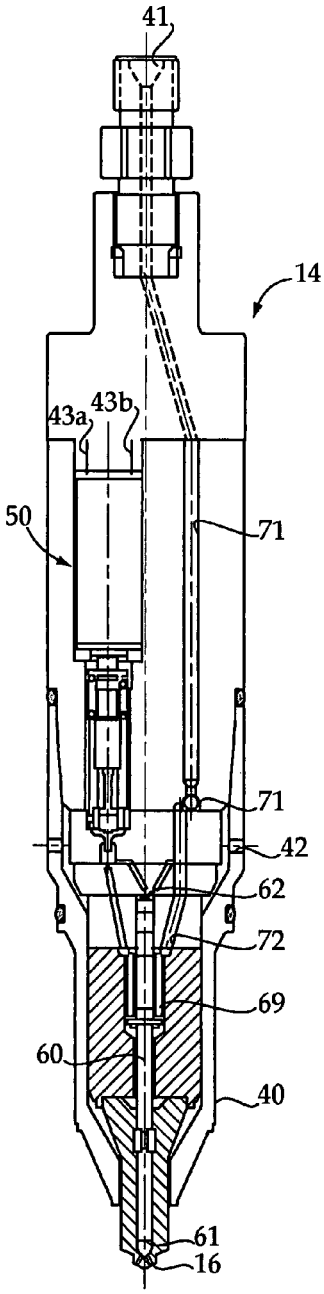
FIG. 3 is a sectioned side view of the fuel injector of FIG. 2 as viewed along section lines 3-3.
Figure 4:
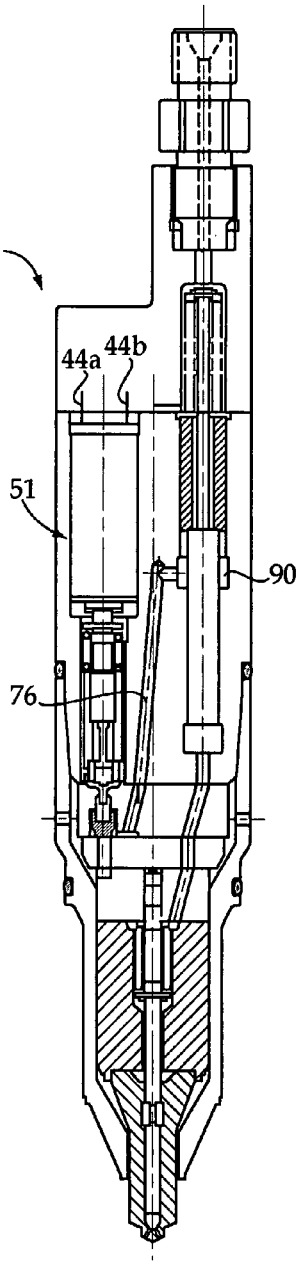
FIG. 4 is a sectioned side view of the fuel injector of FIG. 2 as viewed along section lines 4-4.
Figure 5:
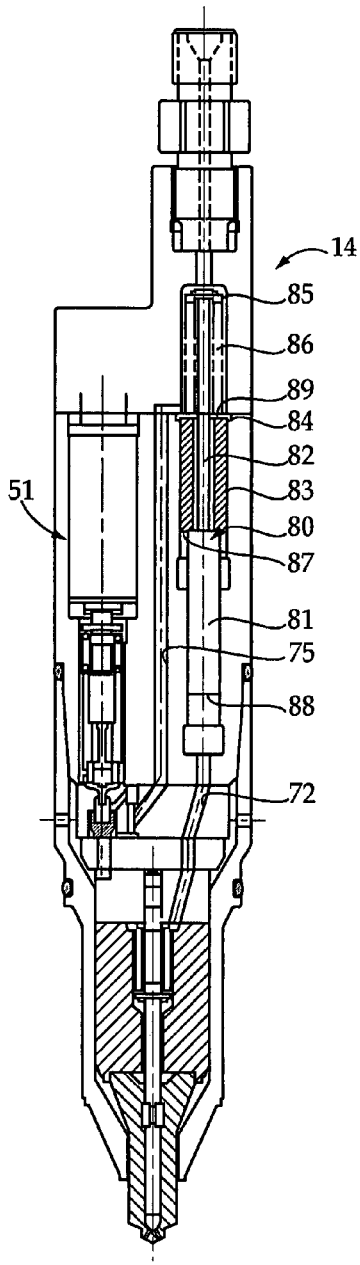
FIG. 5 is a sectioned side view of the fuel injector of FIG. 2 as viewed along section lines 5-5.
Figures 3A, 4A, 5A:
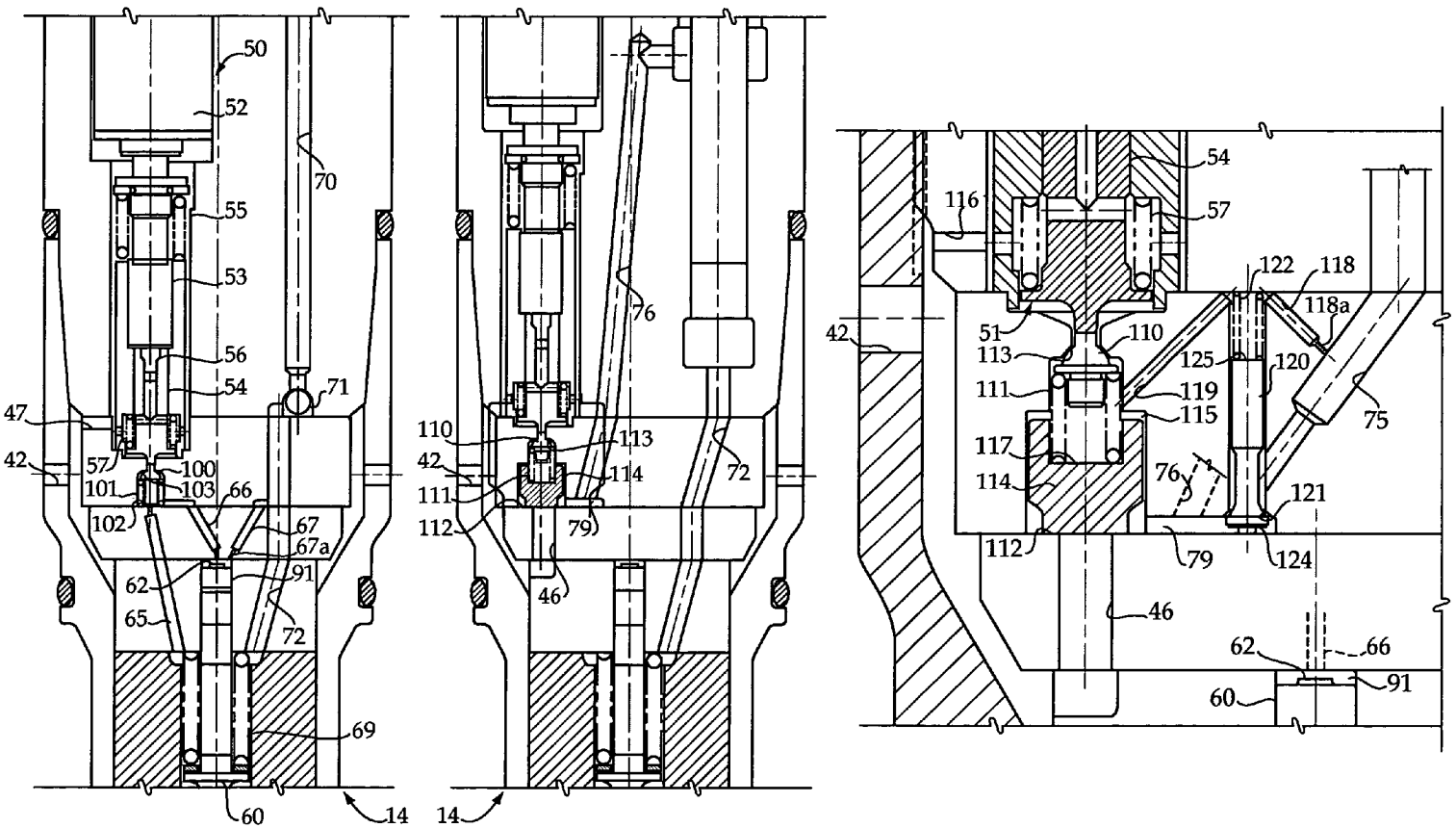
FIG. 3*a* is a partial enlarged view from FIG. 3.
FIG. 4*a* is a partial enlarged view from FIG. 4.
FIG. 5*a* is a partial enlarged view from FIG. 5.
Figure 6:
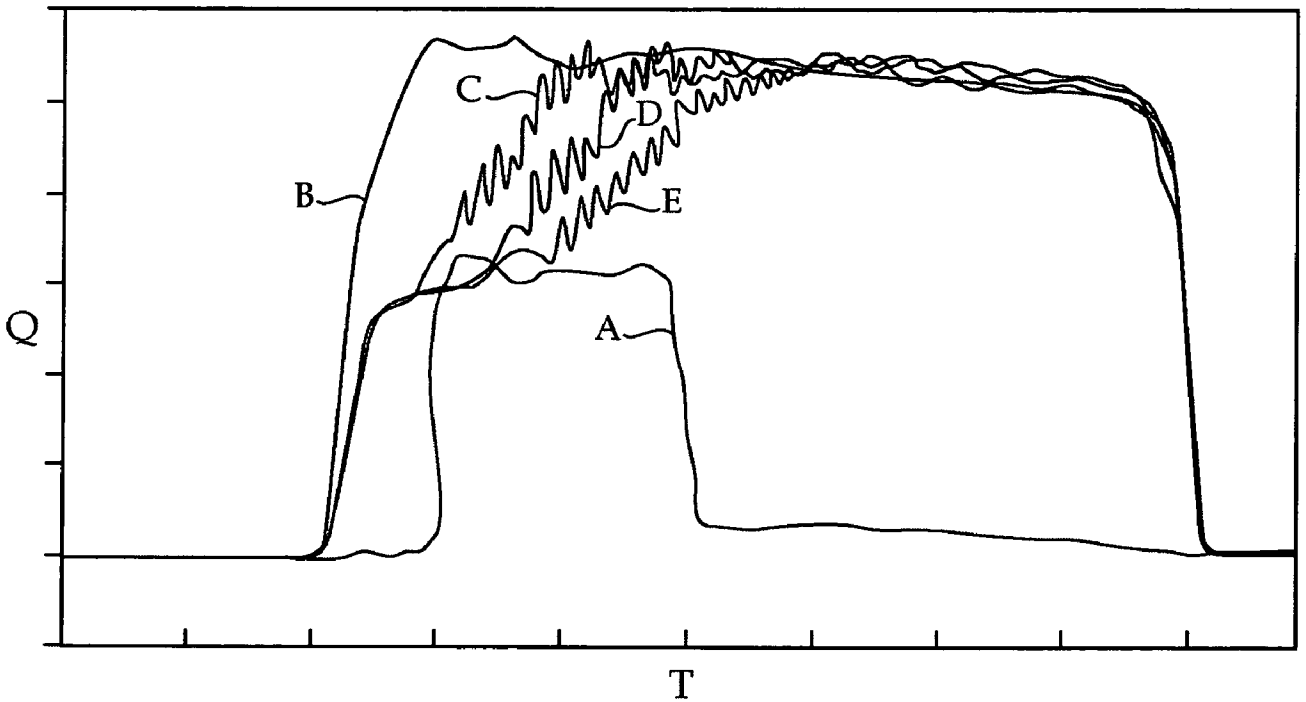
FIG. 6 is a graph of fuel injection rate versus time for several different fuel injection rate shapes according to the present disclosure.

Referring now specifically to FIGS. 3 and 3*a*, the various features most closely associated with control of needle valve member 60 and an enlarged view of the details of one of the electrical actuators are shown. Each of the electrical actuators 50 and 51 include a piezo stack 52 that acts directly on a large piston 53, which is hydraulically linked to a small piston 54 via a hydraulic link 56. Thus, expansion and contraction of piezo stack 52 is multiplied by the ratio in area between large piston 53 and 54 to produce sufficient motion for carrying out the control functions associated with the fuel injector 14. Nevertheless, those skilled in the art will appreciate that alternative strategies could be utilized, including but not limited to using a one or more piezo benders, or a larger piezo stack foregoing the movement multipliers associated with the pistons 53 and 54 as well as a hydraulic link 56. A first spring 55 maintains contact between large piston 53 and piezo stack 52, and a second spring 57 maintains contact between small piston 54 and a direct control valve member 100. Various internal passageways through piezo stack electrical actuator 50 maintain hydraulic link 56 properly filled with fuel between actuations. Those skilled in the art will appreciate that the distance that the piezo stack 52 elongates and the corresponding movement distance of direct control valve member 100 are proportional to the voltage applied to the piezo stack 52 via terminals 43*a* and 43*b* in a conventional manner.

When first piezo stack electrical actuator 50 is de-energized, direct control valve member 100 is biased upward via spring 101 to close conical seat 103 to block needle control chamber 91 from low pressure passage 47 that is fluidly connected to drain port 42. High pressure inlet 41 is fluidly connected directly to nozzle supply passage 72 via a rail injection line 70. A check valve 71 prevents the reverse flow of fuel from nozzle supply passage 72 into rail injection line 70, such as when a high pressure injection event is being performed via intensifier piston 80. Needle control chamber 91 is always unobstructedly fluidly connected to nozzle supply passage 72 via a high pressure passage 67 that includes a flow restriction orifice 67*a*. When first electrical actuator 50 is de-energized such that direct control valve member 100 is in its upper position closing conical seat 103, needle control chamber 91 is also fluidly connected to nozzle supply passage 72 via passage 65 and drain passage 66 past a flat seat 102. Passage 65 may include a flow restriction orifice adjacent flat seat 102 as shown, and drain passage 66 may also include a flow restriction orifice adjacent where it opens into needle control chamber 91, also as shown. Although not necessary, the various passageways associated with needle control chamber 91 are sized and positioned to produce a hydraulic stop when needle valve member 60 moves upward to its open position to open nozzle outlet 16. This is accomplished by energizing first electrical actuator 50 to move direct control valve member 100 downward to close flat seat 102 and open conical valve seat 103. This fluidly connects needle control chamber 91 to drain port 42 via drain passage 66.

As needle valve member 61 rises, a portion of its closing hydraulic surface 62 creates a flow restriction at the opening into drain passage 66. This flow restriction will naturally be larger than the flow restriction 67*a* to cause needle valve member 60 to hover just out of contact with the fuel injector component that defines passages 67 and 66. Those skilled in the art will appreciate that when needle valve member 60 is in its upward open position, there is a direct fluid connection between common rail 18 and drain port 42. However, leakage is severely limited relative to prior art fuel injection systems by employing the hydraulic stop that simultaneously improves reactive performance of the needle valve member 60 while also relaxing other tolerances and minimizing the leakage quantity, and hence energy waste, associated with performing the control function. When first electrical actuator 50 is de-energized to end an injection event, spring 101 urges direct control valve member 100 upward to close conical seat 103. This causes needle control chamber 91 to suddenly be fluidly connected to the high pressure in nozzle supply passage 72 via high pressure passage 67, but also via passage 65 and drain passage 66, to quickly move needle valve member 60 downward to close the nozzle outlet 16. Thus, a relatively low pressure fuel injection event can be performed directly from the common rail 18 by energizing and de-energizing first piezo stack electrical actuator 50.

Referring now to FIGS. 4, 4*a*, 5 and 5*a*, the various features of fuel injector 14 associated with a high pressure injection event via movement of intensifier piston 80 are shown. Intensifier piston 80 includes a plunger 81 that includes small surface 88 and an elongated stem 82. A collar 83 is mounted about stem 82 to define a portion of large surface 89 as well as shoulder 87. A fixed washer 84 is mounted in injector body 40 and serves as a platform for a return spring 86 that is coupled to stem 82 via a return washer 85. Thus, return spring 86 biases intensifier piston 80 upward toward a retracted position as shown. Shoulder 87 is exposed to fluid pressure in a shoulder control chamber 90. Movement of intensifier piston 80 is controlled by fluidly connecting shoulder control chamber 90 either to pressure in common rail 18 or to low pressure drain port 42 via de-actuation and actuation of second piezo stack electrical actuator 51. Downward movement of intensifier piston 80 causes fuel adjacent small surface 88 to be displaced into nozzle supply passage 72 for a high pressure injection event out of nozzle outlet 16. Shoulder control chamber 90 is fluidly connected to a communication chamber 79 via a shoulder passage 76. In turn, communication chamber 79 is normally blocked to low pressure passage 46, which is fluidly connected to drain port 42, via a flat seat valve member 114 that is normally in contact to close flat seat 112. A biasing spring 111 simultaneously biases flat seat valve member 114 into contact with flat seat 112 and intensifier control valve member 110 into contact with conical valve seat 113. Of note is the fact that intensifier control valve member 110, as well as direct control valve member 100 discussed earlier, include rounded or spherical valve surfaces that aid in better seating even in the face of misalignment with conical valve seats 113 and 103, respectively. The flat seat valve member 114 also includes a control surface 117 exposed to fluid pressure in an intensifier control chamber 115. Intensifier control chamber 115 is closed to low pressure passage 116 and hence drain port 42, when intensifier control valve member 110 is seated in conical seat 113 as shown. However, intensifier control chamber 115 is always fluidly connected to common rail 18 via pressure communication passage 119, pressure communication passage 118 and shoulder reset passage 75, which is fluidly connected directly to high pressure inlet 41. Pressure communication passage 118 may include a flow restriction orifice 118*a* that performs in a manner similar to orifice 67*a* discussed earlier. In particular, pressure in intensifier control chamber 115 will remain high until the flow area past conical seat 113 via movement of intensifier control valve member 110 is greater than the flow area through orifice 118*a*. When pressure in intensifier control chamber 115 drops, the higher pressure acting on lifting hydraulic surface 129 pushes flat seat valve member 114 upward to open flat seat 112. This fluidly connects shoulder control chamber 90 to low pressure passage 46 via communication chamber 79 and shoulder passage 76. When this is done, the pressure on shoulder 87 is relieved and rail pressure acts upon large surface 89 of intensifier piston 80 to drive it downward. This will raise pressure in nozzle chamber 72 according to the area ratio of intensifier piston 80 and will close check valve 71 to fluidly isolate nozzle chamber 72 from the common rail 18 during a high pressure event. However, the intensifier piston's movement will not proceed as it will become hydraulically locked unless needle valve member 60 is in an open position to allow fuel to exit via nozzle outlet 16. Thus, a high pressure injection event is accomplished by energizing both first electrical actuator 50 to allow needle valve member 60 to move to an upward open position and also energizing second electrical actuator 51 to relieve pressure on shoulder surface 87 to allow intensifier piston 80 to be driven downward for a high pressure injection event.

Referring now specifically to FIGS. 5 and 5*a*, the various features of fuel injector 14 that allow the intensifier piston 80 to reset to its retracted position between injection events are shown. In particular, the resetting phase is initiated by de-energizing both first and second electrical actuators 50 and 51. When this is done, intensifier control valve member 110 moves upward under the action of spring 111 to close conical valve seat 113. This closes the fluid connection between intensifier control chamber 115 and low pressure passage 116. As such, high pressure returns to intensifier control chamber 115 and acts upon control surface 117 in conjunction with spring 111 to move flat seat valve member 114 downward to close flat seat 112. When the internal components of the fuel injector are in this configuration, biasing spring 122 biases a reset valve member 120 downward to open seat 121 to fluidly connect shoulder passage 76 to shoulder reset passage 75 past seat 121. This fluid connection allows fuel from common rail 18 to flow downward through shoulder passage 76 into communication chamber 79, past seat 121 and eventually to shoulder control chamber 90 via shoulder reset passage 75. These fluid connections should substantially equalize hydraulic pressure on intensifier piston 80 allowing it to retract upward via the action of return spring 86 for a subsequent injection event. Preferably, the various end surfaces 124 and 125 of reset valve member 120 as well as the pre-load on biasing spring 122 are chosen such that reset valve member 120 moves upward to close seat 121 when flat seat valve member 114 is out of contact with flat seat 112 to fluidly connect communication chamber 79 to low pressure passage 46. During a high pressure injection event, when pressure in communication chamber 79 acting on hydraulic surface 124 will be sufficiently high to overcome the downward hydraulic force acting on hydraulic surface 125 combined with the pre-load on spring 122 to close that avenue of leakage during an injection event. The inclusion of reset valve member 120 along with its finely tuned hydraulic surfaces 124 and 125 and the pre-load of spring 122 allow for the avoidance of still another electrical actuator to facilitate resetting fuel injector 14 between injection events.

INDUSTRIAL APPLICABILITY

The present disclosure finds potential application in any common rail fuel injection system. The fuel injector of the present disclosure finds particular application in compression ignition engines. Between injection events, both electrical actuators 50 and 51 are de-energized. In this configuration, nozzle outlet 16 is blocked while both the opening hydraulic surface 60 and closing hydraulic surface 62 of needle valve member 60 are exposed to rail pressure. Intensifier piston 80 is stationary and substantially hydraulically balanced with rail pressure acting on large surface 89, small surface 88 and shoulder surface 87.

Referring now to FIGS. 1, 3, 3*a* and FIG. 6, a low pressure injection event A is accomplished by energizing and de-energizing first piezo electrical actuator 50 while leaving second piezo electrical actuator 51 de-energized. A low pressure injection event in the context of the present disclosure may occur at an extremely high pressure, such as on the order of 160 MPa or above, but is relatively low compared to a higher pressure injection event that utilizes the intensifier piston 80. During a low pressure injection event, the nozzle outlet 16 is fluidly connected directly to the common rail 18 via nozzle supply passage 72 and rail injection line 70. Shortly before the beginning of the desired low pressure injection event, first piezo stack electrical actuator 50 is energized. When it elongates, needle control valve member 100 moves out contact with conical seat 103 to fluidly connect needle control chamber 91 to drain port 42 via drain passage 66 and low pressure passage 47. When this is done, pressure in needle control chamber 91 drops allowing the high pressure force on opening hydraulic surface 61 to overcome the residual hydraulic force on closing hydraulic surface 62 and the pre-load of spring 69 to allow needle valve member 60 to move upward to open nozzle outlet 16. Although not necessary to the present disclosure, the various plumbing may be set up to produce a hydraulic stop for needle valve member 60. This is accomplished by arranging drain passage 66 to open into needle control chamber 91 at a location that interacts with closing hydraulic surface 62. In other words, closing hydraulic surface 62 will move upward and hover just out of contact with the component that defines drain passage 66 to define a flow restriction that will have a larger flow area than the flow restriction 67*a* fluidly connecting needle control chamber 91 to the high pressure in nozzle supply passage 72. This describes the configuration of the various components of fuel injector 14 for a low pressure injection event. The injection event is ended by de-energizing first piezo stack electrical actuator 50. When this is done, biasing spring 101 urges needle control valve member 100 upward to close conical valve seat 103 and simultaneously open flat valve seat 102. This abruptly fluidly connects needle control chamber 91 to the high pressure in nozzle supply passage 72 via both high pressure passage 67 and via passage 65 and drain passage 66 to raise pressure in needle control chamber 91. This will result in needle valve member 60 being roughly hydraulically balanced to allow biasing spring 69 to urge needle valve member 60 downward to close nozzle outlet 16 to conclude the injection event. During a low pressure injection event, intensifier piston 80 remains stationary.

Referring now to FIGS. 1, 4, 4*a* and 5, 5*a* and FIG. 6, a high pressure square injection event B is performed by first energizing second electrical actuator 51 and sometime thereafter energizing first electrical actuator 50. By energizing second piezo stack electrical actuator 51, pressure in shoulder control chamber 90 is relieved and the intensifier piston 80 may be driven downward. However, it becomes hydraulically locked because needle valve member 60 will remain in its downward closed position until first electrical actuator 50 is energized. However, the pressure in nozzle supply passage 72 will increase proportional to the area ratio between small surface 88 and large surface 89 of intensifier piston 80. Thus, the fuel pressure acting on both opening hydraulic surface 61 and closing hydraulic surface 62 at this time may be well above the pressure in common rail 18. When first electrical actuator 50 is then energized to relieve pressure in needle control chamber 91, needle valve member 60 moves quickly to open nozzle outlet 16 to the full elevated pressure existing in nozzle supply passage 72. This results in a near vertical increase in the injection rate as shown by curve B in FIG. 6. The injection event B is ended by de-energizing first electrical actuator 50 to move needle valve member 60 downward to close nozzle outlet 16.

A ramp injection event C may be performed by energizing first and second electrical actuators 50 and 51 at about the same time. When this occurs, the needle valve member 60 moves upward to an open position to open nozzle outlet 16 while pressure is increasing from that of the rail pressure 18 upward as intensifier piston 80 initiates its downward motion and eventually levels off at an injection rate similar to that of the square injection profile B discussed earlier. Fuel injector 14 also has the ability to produce a variety of boot shaped injection profiles D or E by energizing first electrical actuator 50 and then some time thereafter energizing second electrical actuator 51. When this occurs, the injection rate will initially rise up to a plateau associated with the pressure in common rail 18 and thereafter will increase shortly after the second electrical actuator 51 is energized to initiate downward movement of intensifier piston 80. Thus, injection rate profile D would have second electrical actuator 51 be energized closer in time to first electrical actuator 50 than that of injection rate profile E. All high pressure injection events are characterized by a moving intensifier piston and energization of both actuators 50 and 51.

Fuel injector 14 also includes the capability of varying injection pressure during an injection event by energizing and de-energizing second electrical actuator 51 as well as energizing and or de-energizing first electrical actuator 50. For instance, injection at a third pressure may be possible during an injection event by maintaining first electrical actuator 50 energized while de-energizing second electrical actuator 51. This third injection pressure might be possible while intensifier piston 80 is retracting while needle valve member 60 remains open. Eventually, if the intensifier piston fully retracted, the injection rate would return to that associated with injection profile A corresponding to injection directly from the rail 18. Thus, fuel injector 14 may also have some middle and end of injection shaping rate capability by selecting the timing of the energizing second electrical actuator 51 relative to that of first electrical actuator 50. This ability to modulate injection pressure during an injection event is a relatively new capability for fuel injection systems that could reveal new ways in which emissions may be reduced and/or performance possibly increased.

Another subtle feature associated with fuel injector 14 is the possibility of adjusting the slope of the front end ramp rate shape for the injection event by adjusting a movement rate of the intensifier piston by adjusting an energization voltage on the second piezo stack electrical actuator 51. In other words, by adjusting the voltage on second piezo stack electrical actuator 51, the flow area across seat 113 can be adjusted and hence the pressure in intensifier control chamber 115 may be controlled. This in turn adjusts the forces on flat seat valve member 114 to precisely control the flow area past flat seat 112 to control the rate at which fluid may be evacuated from shoulder control chamber 19 and hence control the movement rate of intensifier piston 80. Of course, the movement rate of intensifier piston 80 in turn controls what pressure is experienced in nozzle supply passage 72 and hence nozzle outlet 16. Thus, unlike solenoid controlled valves, the valves of the present disclosure can be stopped at any position based upon certain voltages applied to the piezo stack electrical actuators. While it is quite likely that the precise voltage to produce a certain effect in one injector may be different from that of an apparently identical fuel injector, those skilled in the art will appreciate that performance differences between fuel injectors can be alleviated using known electronic trim strategies.

It should be understood that the above description is intended for illustrative purposes only, and is not intended to limit the scope of the present disclosure in any way. Thus, those skilled in the art will appreciate that other aspects, objects, and advantages of the disclosure can be obtained from a study of the drawings, the disclosure and the appended claims.

What is claimed is:

1. A fuel injector comprising:

an injector body including a high pressure inlet, a low pressure drain and a nozzle outlet, and including a nozzle supply passage, a needle control chamber and a shoulder control chamber disposed therein;

a first electrical actuator, which includes a piezo stack, positioned in the injector body;

a second electrical actuator, which includes a piezo stack, positioned in the injector body;

an intensifier piston slidably positioned in the injector body with a shoulder surface that is exposed to fluid pressure in the shoulder control chamber and located between a large surface and a small surface;

a needle valve member with an opening hydraulic surface exposed to fluid pressure in the nozzle supply passage, and a closing hydraulic surface exposed to fluid pressure in the needle control chamber;

a direct control valve member coupled to the first electrical actuator and being movable between a first position at which the needle control chamber is fluidly connected to the low pressure drain, and a second position at which the needle control chamber is fluidly blocked to the low pressure drain;

an intensifier control valve coupled to the second electrical actuator and movable between a first position at which the shoulder control chamber is fluidly connected to the low pressure drain, and a second position at which the shoulder control chamber is fluidly blocked to the low pressure drain; and an injector reset valve member movable between a first position at which the shoulder control chamber is fluidly connected to the common rail, and a second position at which the shoulder control chamber is fluidly blocked to the common rail.

2. The fuel injector of claim 1 wherein the intensifier control valve includes a control valve member in contact with the second electrical actuator and a flat seat valve member with a control surface exposed to fluid pressure in an intensifier control chamber;

the control valve member being movable between a first position at which the intensifier control chamber is fluidly blocked from the low pressure drain, and a second position at which the intensifier control chamber is fluidly connected to the low pressure drain; and the flat seat valve member being movable between a first position in contact with a flat valve seat, and a second position out of contact with the flat valve seat.

3. The fuel injector of claim 2 wherein the flat seat valve member has a continuum of different positions between the first position and the second position that each correspond to a different flow area between the intensifier control chamber and the low pressure drain; and each of the continuum of different positions corresponds to a different voltage on the piezo stack of the second electrical actuator.

4. The fuel injector of claim 1 including an unobstructed passage that maintains fluid communication between the common rail and the needle control chamber;

a drain passage that opens into the needle control chamber at a location that produces a hydraulic stop when the needle valve member is in an open position with the closing hydraulic surface restricting a flow of fluid from the needle control chamber into the low pressure drain.

5. The fuel injector of claim 1 wherein the direct control valve member is in contact with the first electrical actuator;

the control valve member is out of contact with a flat seat to fluidly connect the common rail to the needle control chamber in the second position; and the control valve member is in contact with the flat seat to fluidly block a passage between the common rail and the needle control chamber.

6. The fuel injector of claim 1 wherein the intensifier control valve includes a control valve member in contact with the second electrical actuator and a pilot valve member with a control surface exposed to fluid pressure in an intensifier control chamber;

the control valve member being movable between a first position at which the intensifier control chamber is fluidly blocked from the low pressure drain, and a second position at which the intensifier control chamber is fluidly connected to the low pressure drain;

an unobstructed passage that maintains fluid communication between the common rail and the needle control chamber;

a drain passage that opens into the needle control chamber at a location that produces a hydraulic stop when the needle valve member is in an open position with the closing hydraulic surface restricting a flow of fluid from the needle control chamber into the drain passage.

7. An engine comprising:

an engine housing having a plurality of cylinders disposed therein;

a plurality of fuel injectors that each include a nozzle outlet positioned for direct injection into a different one of the cylinders, and each of the fuel injectors includes a plurality of components;

a common rail fluidly connected to each of the fuel injectors;

the plurality of components including a needle valve member, an intensifier piston, a first piezo stack electrical actuator and a second piezo stack electrical actuator;

the plurality of components having a first configuration at which the needle valve member blocks the nozzle outlet, and a shoulder surface of the intensifier piston is exposed to fluid pressure in the common rail;

the plurality of components having a second configuration at which the nozzle outlet is fluidly connected to the common rail for a low pressure injection; and the plurality of components having a third configuration at which the shoulder surface is fluidly blocked from fluid pressure in the common rail, and the nozzle outlet is fluidly blocked from the common rail, but movement of the intensifier displaces fluid through the nozzle outlet for a high pressure injection.

8. The engine of claim 7 wherein the intensifier piston includes the shoulder surface located between a large surface and a small surface;

the shoulder surface is exposed to fluid pressure in a shoulder control chamber;

the shoulder control chamber being fluidly blocked to a low pressure drain but fluidly connected to the common rail in the first configuration and the second configuration; and the shoulder control chamber being fluidly blocked from the common rail but fluidly connected to the low pressure drain in the third configuration.

9. The engine of claim 8 wherein all of the shoulder surface, the large surface and the small surface of the intensifier piston are exposed to fluid pressure in the common rail in the first configuration.

10. The engine of claim 8 wherein the shoulder control chamber is fluidly connected to the low pressure drain via a variable flow area valve in the third configuration; and a flow area of the variable flow area valve being responsive to an energization voltage level of the second piezo stack electrical actuator.

11. The engine of claim 7 wherein neither of the first and second piezo stack electrical actuators is energized in the first configuration;

one, but not both, of the first and second piezo stack electrical actuators is energized in the second configuration; and both the first and second piezo stack electrical actuators are energized in the third configuration.

12. The engine of claim 7 wherein the first and second piezo stack electrical actuators are identical; and the plurality of components include an injector reset valve member, a first control valve member, a second control valve member and a flat seat valve member.

13. The engine of claim 8 wherein the plurality of components include a control valve member in contact with a second piezo stack electrical actuator, and a flat seat valve member with a control surface exposed to fluid pressure in a intensifier control chamber;

the control valve member being movable between a first position at which the intensifier control chamber is fluidly blocked from the low pressure drain, and a second position at which the intensifier control chamber is fluidly connected to the low pressure drain; and the flat seat valve member being movable between a first position in contact with a flat valve seat, and a second position out of contact with the flat valve seat.

14. A method of operating a fuel injection system, comprising the steps of:

fluidly connecting a nozzle outlet of a fuel injector to a common rail for a low pressure injection event by energizing one, but not both, of a first electrical actuator and a second electrical actuator;

moving an intensifier piston with fluid pressure from the common rail for a high pressure injection event by energizing both of the first and second electrical actuators;

exposing both ends and a shoulder surface of the intensifier piston as well as both an opening hydraulic surface and a closing hydraulic surface of a needle valve member to pressure in the common rail by de-energizing both of the first and second electrical actuators; and blocking the shoulder surface from fluid pressure in the common rail during the high pressure injection event.

15. The method of claim 14 including a step of hydraulically stopping the needle member in an open position for either of low pressure injection event or the high pressure injection event.

16. The method of claim 14 wherein the moving step includes adjusting a movement rate of the intensifier piston by adjusting an energization voltage on a piezo stack of the second electrical actuator.

17. The method of claim 16 wherein the adjusting step includes changing a pressure in an intensifier control chamber; and exposing a flat seat valve member to fluid pressure in the intensifier control chamber.

18. The method of claim 14 including a step of ending an injection event by fluidly connecting a needle control chamber to the common rail via two different passages; and exposing the closing hydraulic surface of the needle valve member to fluid pressure in the needle control chamber.

19. The method of claim 14 including a step of front end rate shaping an injection event by energizing the second electrical actuator at a different time than the first electrical actuator.

* * * * *